US011384512B2

(12) United States Patent
Nakashima et al.

(10) Patent No.: US 11,384,512 B2
(45) Date of Patent: Jul. 12, 2022

(54) WORK MACHINE

(71) Applicant: KOMATSU LTD., Tokyo (JP)

(72) Inventors: Akira Nakashima, Tokyo (JP); Isamu Oda, Tokyo (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 17/275,945

(22) PCT Filed: Oct. 31, 2019

(86) PCT No.: PCT/JP2019/042802

§ 371 (c)(1),
(2) Date: Mar. 12, 2021

(87) PCT Pub. No.: WO2020/100613

PCT Pub. Date: May 22, 2020

(65) Prior Publication Data

US 2022/0034068 A1 Feb. 3, 2022

(30) Foreign Application Priority Data

Nov. 15, 2018 (JP) ..... JP2018-215047

(51) Int. Cl.
*E02F 9/22* (2006.01)
*F15B 21/0423* (2019.01)
(Continued)

(52) U.S. Cl.
CPC ..... *E02F 9/2235* (2013.01); *E02F 9/226* (2013.01); *E02F 9/2228* (2013.01);
(Continued)

(58) Field of Classification Search
CPC .. F15B 11/165; F15B 11/166; F15B 21/0423; F15B 2211/62
See application file for complete search history.

(56) References Cited

U.S. PATENT DOCUMENTS 6,408,622 B1 6/2002 Tsuruga et al.
8,082,082 B2 * 12/2011 Matsuyama ..... B60W 10/30 701/50
(Continued)

FOREIGN PATENT DOCUMENTS

CN 101506484 A 8/2009
CN 102933857 A 2/2013
(Continued)

OTHER PUBLICATIONS

The International Search Report for the corresponding international application No. PCT/JP2019/042802, dated Jan. 21, 2020.
(Continued)

*Primary Examiner* — Michael Leslie
(74) *Attorney, Agent, or Firm* — Global IP Counselors, LLP

(57) ABSTRACT

A load sensing valve maintains a differential pressure at a set pressure by controlling a regulator in accordance with a differential pressure between a discharge pressure of a hydraulic pump and a load pressure of hydraulic actuators. A set pressure control device controls the set pressure. A controller controls the set pressure control device to reduce the set pressure more than when the work implement is being operated, when a predetermined determination condition that includes the work implement not being operated is satisfied.

6 Claims, 5 Drawing Sheets

(51) Int. Cl.

| | |
|---|---|
| ***F15B 11/16*** | (2006.01) |
| ***F15B 15/20*** | (2006.01) |
| *E02F 3/76* | (2006.01) |
| *E02F 9/20* | (2006.01) |

(52) U.S. Cl.

CPC ..... *E02F 9/2296* (2013.01); *F15B 11/165* (2013.01); *F15B 11/166* (2013.01); *F15B 15/20* (2013.01); *F15B 21/0423* (2019.01); *E02F 3/7609* (2013.01); *E02F 9/2004* (2013.01); *E02F 9/2285* (2013.01); *F15B 2211/62* (2013.01)

(56) References Cited

U.S. PATENT DOCUMENTS

| | | | | |
|---|---|---|---|---|
| 9,127,697 | B1 * | 9/2015 | Throckmorton | F16H 61/4008 |
| 9,580,889 | B2 * | 2/2017 | Kure | F01P 1/06 |
| 2010/0303643 | A1 | 12/2010 | Kataoka et al. | |
| 2013/0055705 | A1 | 3/2013 | Mori et al. | |
| 2016/0138624 | A1 * | 5/2016 | Oftelie | F15B 19/005 701/50 |

FOREIGN PATENT DOCUMENTS

| | | | |
|---|---|---|---|
| JP | 4-285304 | A | 10/1992 |
| JP | 2000-192905 | A | 7/2000 |
| JP | 2003-314501 | A | 11/2003 |
| JP | 2005-344766 | A | 12/2005 |
| JP | 2017-136887 | A | 8/2017 |

OTHER PUBLICATIONS

Office Action for the corresponding Chinese application No. 201980056738.0, dated Jan. 19, 2022.

* cited by examiner

| WORK IMPLEMENT OPERATION | TRAVEL OPERATION | | |
|---|---|---|---|
| | F | N | R |
| YES | OFF | OFF | OFF |
| NO | OFF | OFF | ON |

FIG. 4

WORK MACHINE

CROSS-REFERENCE TO RELATED APPLICATIONS

This application is a U.S. National stage application of International Application No. PCT/JP2019/042802, filed on Oct. 31, 2019. This U.S. National stage application claims priority under 35 U.S.C. § 119(a) to Japanese Patent Application No. 2018-215047, filed in Japan on Nov. 15, 2018, the entire contents of which are hereby incorporated herein by reference.

BACKGROUND

Field of the Invention

The present invention relates to a work machine.

Background Information

A work machine, such as a bulldozer, includes a hydraulic pump, a hydraulic actuator, and a work implement, as shown in Japanese Laid-Open Patent Publication No. H4-285304. The hydraulic actuator is driven by hydraulic fluid discharged from the hydraulic pump to operate the work implement. In addition, a load sensing valve is provided in the work machine. The load sensing valve controls the discharge displacement of the hydraulic pump so that a differential pressure between the discharge pressure of the hydraulic pump and the load pressure of the hydraulic actuator is held at a predetermined set pressure.

SUMMARY

However, a hydraulic motor and a fan are provided in the work machine. The hydraulic motor is driven by hydraulic fluid discharged from the hydraulic pump to rotate the fan. Therefore, the hydraulic fluid discharged from the hydraulic pump is distributed to the hydraulic actuator for the work implement and to the hydraulic motor for the fan.

In the work machine described above, the set pressure of the load sensing valve is set to a suitable value when driving the work implement that applies a large load to the hydraulic actuator. Therefore, when the work implement is not operated and only the hydraulic motor for the fan is driven, the hydraulic pump discharges the hydraulic fluid at an excessive pressure. As a result, the energy loss of the hydraulic pump is great.

An object of the present invention is to reduce the energy loss of a hydraulic pump in a work machine.

A work machine according to one aspect includes a variable displacement hydraulic pump, hydraulic actuators, a work implement, a fan, a control valve, a regulator, a load sensing valve, a set pressure control device, and a controller. The hydraulic actuators include a work implement actuator and a hydraulic motor and are driven by hydraulic fluid discharged from the hydraulic pump. The work implement is connected to the work implement actuator. The fan is connected to the hydraulic motor. The control valve controls the flow rate of the hydraulic fluid supplied from the hydraulic pump to the hydraulic actuators. The regulator controls the discharge displacement of the hydraulic pump. The load sensing valve controls the regulator in accordance with a differential pressure between a discharge pressure of the hydraulic pump and a load pressure of the hydraulic actuators to maintain the differential pressure at a set pressure. The set pressure control device controls the set pressure. The controller controls the set pressure control device so that the set pressure is reduced more when a determination condition, which includes the fact that the work implement is not being operated, is satisfied than when the work implement is being operated.

According to the present invention, energy loss of the hydraulic pump in the work machine can be reduced.

BRIEF DESCRIPTION OF DRAWINGS

FIG. 4 illustrates a determination condition for controlling a set pressure control device.

DETAILED DESCRIPTION OF EMBODIMENTS

Figure 1:
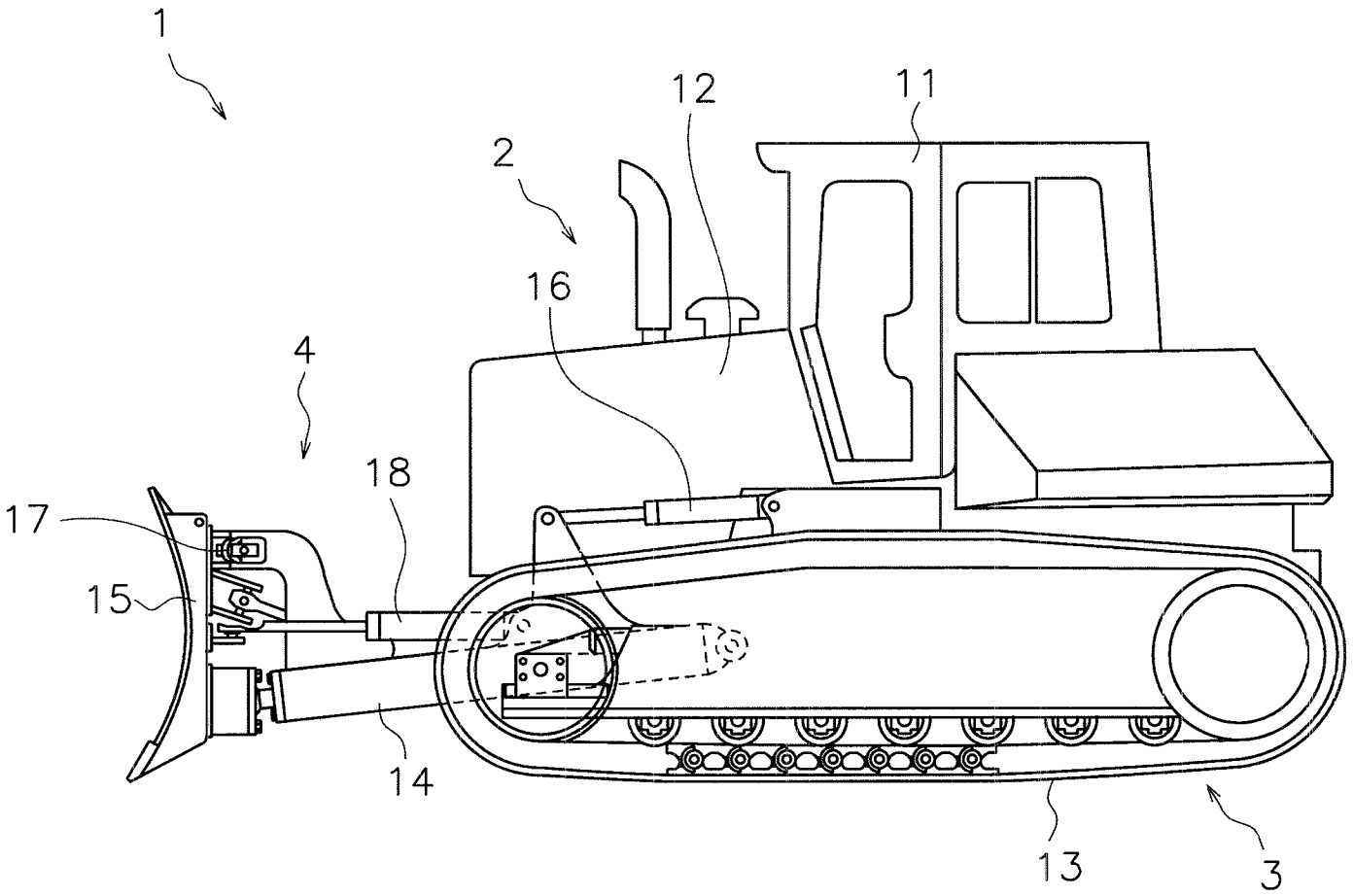
FIG. 1 is a side view of the work machine.

A work machine 1 according to an embodiment will be discussed below with reference to the drawings. FIG. 1 is a side view of the work machine 1. The work machine 1 according to the present embodiment is a bulldozer. The work machine 1 includes a vehicle body 2, a travel device 3, and a work implement 4. The vehicle body 2 includes an operator's cab 11 and an engine compartment 12. The engine compartment 12 is disposed in front of the operator's cab 11. The travel device 3 is attached to a bottom portion of the vehicle body 2. The travel device 3 includes a pair of left and right crawler belts 13. Only the crawler belt 13 on the left side is illustrated in FIG. 1. The work machine 1 travels due to the rotation of the crawler belts 13.

The work implement 4 is attached to the vehicle body 2. The work implement 4 has a lift frame 14 and a blade 15. The lift frame 14 is attached to the vehicle body 2 in a manner that allows movement up and down. The lift frame 14 supports the blade 15. The blade 15 is disposed in front of the vehicle body 2. The work machine 1 includes work implement actuators 16 to 18. The work implement actuators 16 to 18 include a lift cylinder 16, a tilt cylinder 17, and an angle cylinder 18. The lift cylinder 16, the tilt cylinder 17, and the angle cylinder 18 are connected to the work implement 4.

Specifically the lift cylinder 16 is coupled to the vehicle body 2 and the lift frame 14. The blade 15 moves up and down (referred to below as "lifting motion") due to the extension and contraction of the lift cylinder 16. The tilt cylinder 17 is connected to the lift frame 14 and the blade 15. The left and right ends of the blade 15 moves up and down and the blade 15 tilts (referred to below as "tilting motion") due to the extension and contraction of the tilt cylinders 17. The angle cylinder 18 is connected to the lift frame 14 and the blade 15. The left and right ends of the blade 15 move forward and backward and the blade 15 tilts (referred to below as "angling motion") due to the extension and contraction of the angle cylinder 18.

Figure 2:
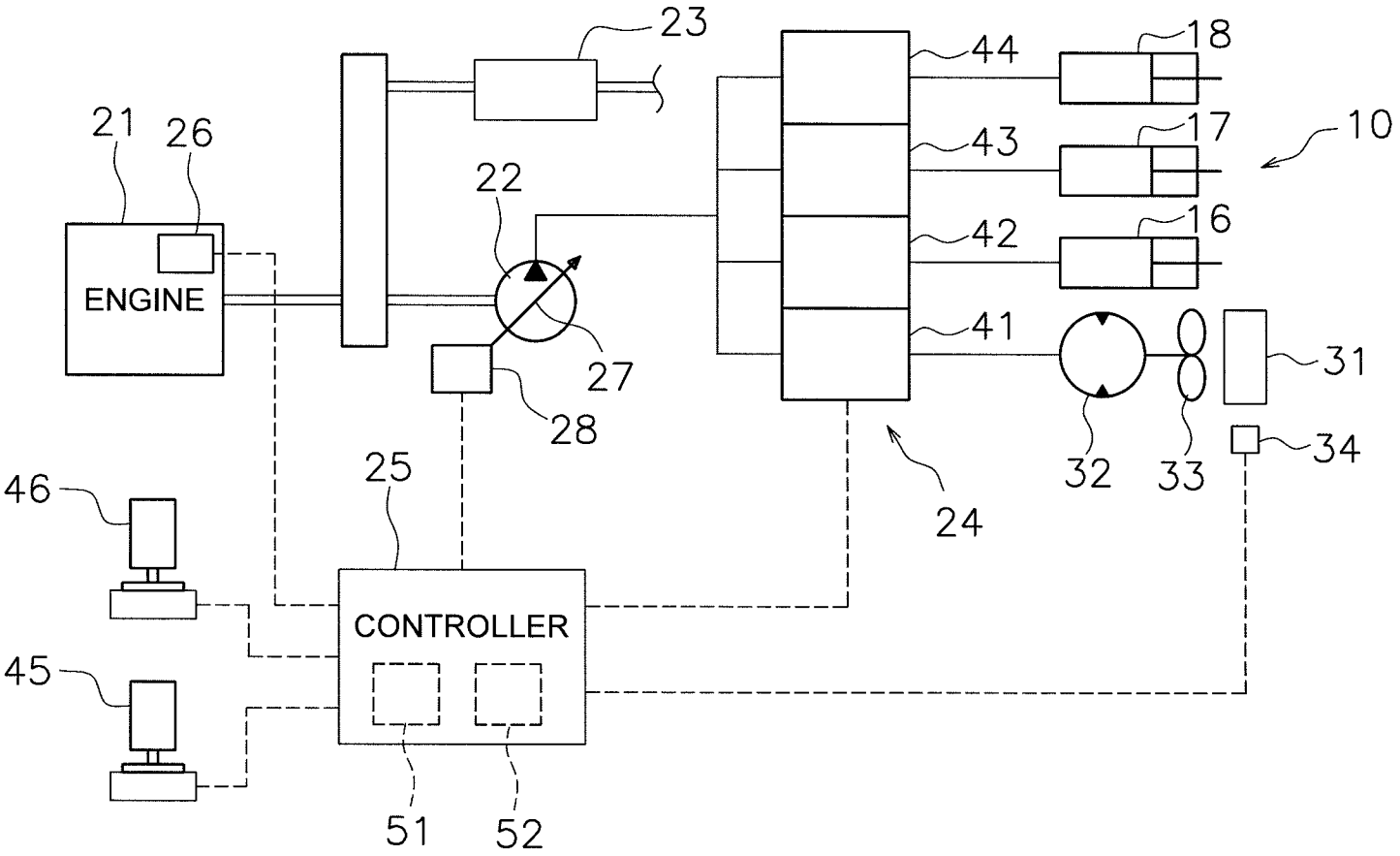
FIG. 2 is a block diagram illustrating a configuration of the work machine.

FIG. 2 is a block diagram of a configuration of a control system of the work machine 1. As illustrated in FIG. 2, the work machine 1 includes an engine 21, a hydraulic pump 22, a power transmission device 23, a control valve 24, and a controller 25.

The engine 21 is an internal combustion engine, such as a diesel engine. The output of the engine 21 is controlled by adjusting an injection amount of fuel from a fuel injection device 26. The adjustment of the fuel injection amount is performed by the controller 25 controlling the fuel injection device 26. The hydraulic pump 22 is driven by the engine 21 to discharge hydraulic fluid. The hydraulic fluid discharged from the hydraulic pump 22 is supplied to the work implement actuators 16 to 18 via the control valve 24. The work implement actuators 16 to 18 are driven by hydraulic fluid discharged from the hydraulic pump 22.

The hydraulic pump 22 is a variable displacement hydraulic pump. The displacement of the hydraulic pump 22 is controlled by controlling a tilt angle of a swash plate 27. The displacement of the hydraulic pump 22 signifies the discharge amount of hydraulic fluid per one rotation of the hydraulic pump 22. The discharge displacement is determined by the angle of the swash plate 27. A pump control device 28 is connected to the hydraulic pump 22. The tilt angle of the swash plate 27 of the hydraulic pump 22 is controlled by the pump control device 28. A detailed explanation of the pump control device 28 is provided below.

The power transmission device 23 transmits the driving power of the engine 21 to the travel device 3. The power transmission device 23 may be a hydrostatic transmission (FIST), for example. Alternatively, the power transmission device 23, for example, may be a transmission having a torque converter or a plurality of speed change gears.

The work machine 1 includes a cooling device 31, a hydraulic motor 32, a fan 33, and a temperature sensor 34. The cooling device 31 is, for example, a radiator and cools cooling water for the engine 21. The hydraulic motor 32 is driven by hydraulic fluid discharged from the hydraulic pump 22. The fan 33 is connected to the hydraulic motor 32. The fan 33 is rotationally driven by the hydraulic motor 32 thereby generating an air flow for cooling the cooling water in the cooling device 31. The temperature sensor 34 detects the temperature of the cooling water. The temperature sensor 34 outputs a detection signal indicative of the detected temperature of the cooling water.

The control valve 24 is controlled by command signals from the controller 25. The control valve 24 is connected to the hydraulic actuators 10 and the work implement pump 22 through a hydraulic circuit. The hydraulic actuators 10 include the above-mentioned work implement actuators 16 to 18 and the hydraulic motor 32. The hydraulic fluid discharged from the hydraulic pump 22 is supplied to the work implement actuators 16 to 18 and the hydraulic motor 32 via the control valve 24. The control valve 24 changes the opening degree of the control valve 24 in accordance with the command signals from the controller 25. Consequently, the control valve 24 controls the flow rate of hydraulic fluid supplied from the hydraulic pump 22 to the work implement actuators 16 to 18 and the hydraulic motor 32. The control valve 24 may also be controlled by supplying a pilot hydraulic pressure.

Specifically, the control valve 24 includes a fan control valve 41, a first control valve 42, a second control valve 43, and a third control valve 44. The fan control valve 41 controls the flow rate of the hydraulic fluid supplied from the hydraulic pump 22 to the hydraulic motor 32. The first control valve 42 controls the flow rate of the hydraulic fluid supplied from the hydraulic pump 22 to the lift cylinder 16. The second control valve 43 controls the flow rate of the hydraulic fluid supplied from the hydraulic pump 22 to the tilt cylinder 17. The third control valve 44 controls the flow rate of the hydraulic fluid supplied from the hydraulic pump 22 to the angle cylinder 18.

The work machine 1 includes a work implement operating member 45 and a travel operating member 46. The work implement operating member 45 and the travel operating member 46 are disposed in the operator's cab 11. The work implement operating member 45 is a member for operating the work implement 4. The work implement operating member 45 is manually operable in the operating positions for the lifting motion, the tilting motion, and the angling motion of the blade 15. The work implement operating member 45 receives an operation from an operator for driving the work implement 4 and outputs an operation signal corresponding to the operation.

The travel operating member 46 is, for example, a travel lever and is a member for operating the travel device 3. The travel operating member 46 is manually operable in a forward travel position, a reverse travel position, and a neutral position. The travel operating member 46 receives an operation from the operator for driving the work machine 1 and outputs an operation signal corresponding to the operation. The operation signal of the work implement operating member 45 and the operation signal of the travel operating member 46 are outputted to the controller 25.

The controller 25 is programmed to control the work machine 1 based on acquired data. The controller 25 includes a processor 51 and a memory 52. The processor 51 is, for example, a CPU and executes processing for controlling the work machine 1. The memory 52 includes, for example, a volatile memory and a non-volatile memory. The memory 52 records computer commands that are executable by the processor and that are for controlling the work machine 1.

The controller 25 acquires operation signals from the work implement operating member 45 and the travel operating member 46. The controller 25 controls the travel device 3, the engine 21, and the power transmission device 23 in accordance with the operation signals from the travel operating member 46 to travel the work machine 1. The controller 25 controls the control valve 24 in accordance with the operation signals from the work implement operating member 45 to move the work implement 4 and the fan 33. The work implement operating member 45 and the travel operating member 46 are not limited to levers and may be other members, such as a pedal or a switch. The work implement operating member 45 and the travel operating member 46 are not limited to outputting electrical operation signals and may output pilot hydraulic pressures that correspond to the operations. In this case, the controller 25 may detect the pilot hydraulic pressures from the work implement operating member 45 and the travel operating member 46 with a hydraulic pressure sensor and may acquire operation signals indicative of the pilot hydraulic pressures.

A configuration of the pump control device 28 will be explained next. The pump control device 28 controls the angle of the swash plate 27 so that the differential pressure between the discharge pressure of the hydraulic pump 22 and the load pressure of the hydraulic actuators 10 is constant. The load pressure of the hydraulic actuators 10 may be the greatest among the load pressures of the work implement actuators 16 to 18 and the hydraulic motor 32. Alternatively, the load pressure of the hydraulic actuators 10 may be another pressure determined based on the load pressures of the work implement actuators 16 to 18 and the hydraulic motor 32.

Figure 3:
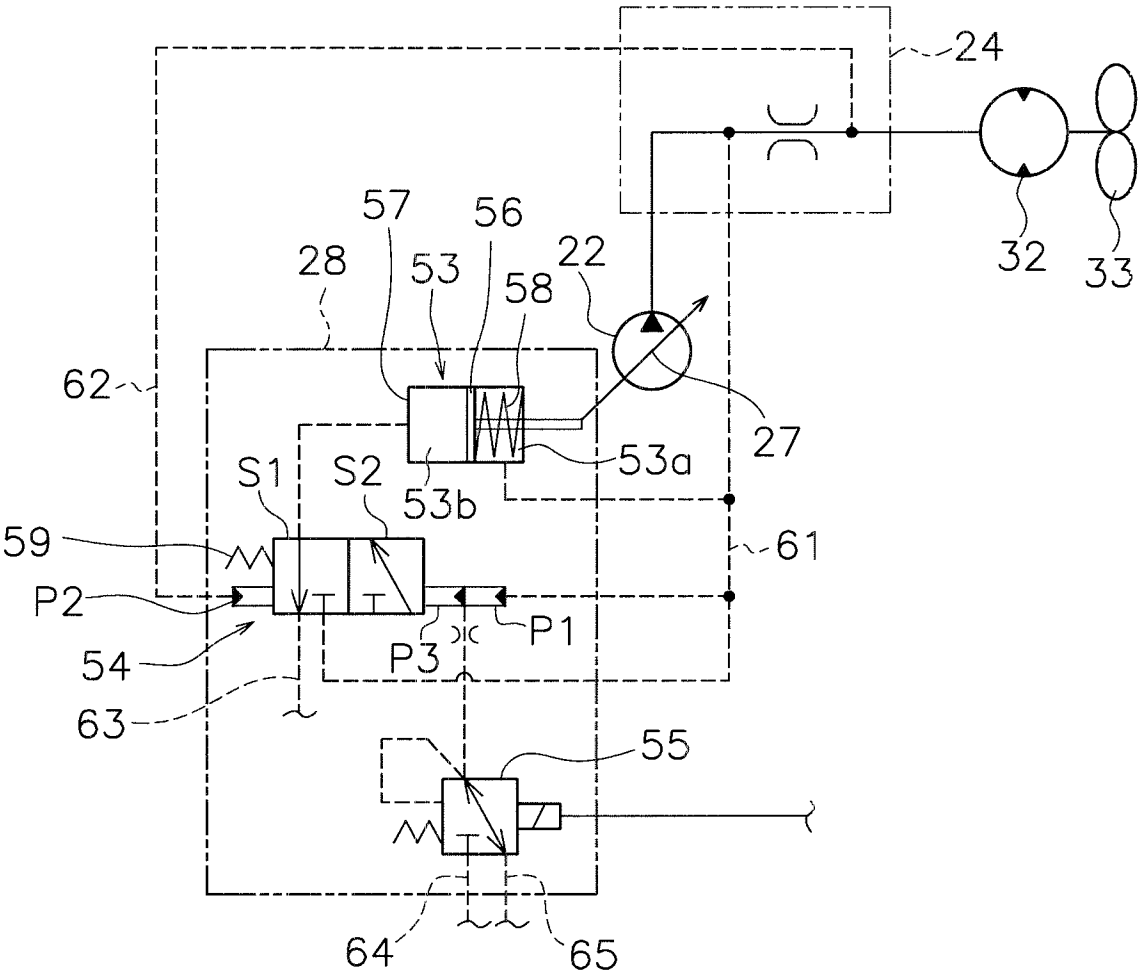
FIG. 3 is a schematic view of a configuration of the pump control device.

FIG. 3 is a schematic view illustrating a configuration of the pump control device 28. As illustrated in FIG. 3, the pump control device 28 has a regulator 53, a load sensing valve 54 (referred to below as "LS valve 54"), and a set pressure control device 55.

The regulator 53 is a servo piston and controls the discharge displacement of the hydraulic pump 22. The regulator 53 includes a piston 56 and a cylinder 57. The piston 56 is coupled to the swash plate 27. A first chamber 53*a* and a second chamber 53*b* are provided inside the cylinder 57 with the piston 56 interposed therebetween. The piston 56 is urged from the first chamber 53*a* side toward the second chamber 53*b* side by a spring 58. As a result, the position of the piston 56 inside the cylinder 57 is determined by the balance between the resultant force of the spring force of the spring 58 and the force of the hydraulic pressure inside the first chamber 53*a*, and the force of the hydraulic pressure inside the second chamber 53*b*. When the piston 56 moves to the second chamber 53*b* side (toward the left in FIG. 2), the angle of the swash plate 27 increases and the discharge displacement of the hydraulic pump 22 increases. Alternatively, when the piston 56 moves to the first chamber 53*b* side, the angle of the swash plate 27 decreases and the discharge displacement of the hydraulic pump 22 decreases.

The LS valve 54 maintains a differential pressure at a set pressure by controlling the regulator 53 in accordance with the differential pressure between the discharge pressure of a hydraulic pump 22 and the load pressure of the hydraulic actuators 10. The LS valve 54 controls the angle of the swash plate 27 so that the differential pressure is constant at the set pressure. The LS valve 54 includes a first pilot port P1, a second pilot port P2, and a third pilot port P3. The first pilot port P1 is connected to the discharge side of the hydraulic pump 22 through a first pilot circuit 61. The discharge pressure of the hydraulic pump 22 is applied to the first pilot port P1 as a pilot pressure through the first pilot circuit 61. The second pilot port P2 is connected to the load side of the control valve 24 through a second pilot circuit 62. The load pressure of the hydraulic actuators 10 is applied to the second pilot port P2 as a pilot pressure through the second pilot circuit 62. The third pilot port P3 is connected to the set pressure control device 55.

The LS valve 54 is switched between a state S1 and a state S2. The LS valve 54 connects the second chamber 53*b* of the cylinder 57 to a drain circuit 63 in the state S1. Consequently, the hydraulic fluid from the second chamber 53*b* is exhausted and the hydraulic pressure of the second chamber 53*b* decreases. The LS valve 54 connects the second chamber 53*b* to the first pilot circuit 61 in the state S2. Consequently, hydraulic fluid is supplied to the second chamber 53*b* and the hydraulic pressure of the second chamber 53*b* increases.

A spring 59 is provided to the LS valve 54 and urges the LS valve 54 toward the state S1. The set pressure of the LS valve 54 is determined by the urging force of the spring 59 and the pilot pressure applied to the third pilot port P3. When the differential pressure is less than the set pressure of the LS valve 54, the LS valve 54 enters the state S1. In this state, the hydraulic pressure of the second chamber 53*b* of the regulator 53 decreases and the piston 56 moves toward the left in FIG. 3. As a result, the angle of the swash plate 27 increases and the discharge displacement of the hydraulic pump 22 increases.

In addition, when the differential pressure is greater than the set pressure, the LS valve 54 switches to the state S2. In this state, the LS valve 54 supplies hydraulic fluid to the second chamber 53*b* of the regulator 53 through the first pilot circuit 61. Consequently, the hydraulic pressure of the second chamber 53*b* increases and the piston 56 inside the regulator 53 moves to the right in FIG. 3. As a result, the angle of the swash plate 27 decreases and the discharge displacement of the hydraulic pump 22 decreases.

The set pressure control device 55 controls the set pressure of the above-mentioned LS valve 54. Specifically, the set pressure control device 55 switches the set pressure between a predetermined first pressure and a predetermined second pressure. The second pressure is smaller than the first pressure. The set pressure control device 55 is an electromagnetic control valve controlled by command signals from the controller 25.

The set pressure control device 55 switches between an off-state and an on-state in accordance with the command signals from the controller 25. The set pressure control device 55 causes the third pilot port P3 of the LS valve 54 to be in communication with a drain circuit 64 in the off-state. At this time, no pilot pressure is supplied from the set pressure control device 55 to the third pilot port P3, and the set pressure of the LS valve 54 is set to the first pressure determined by the spring 59.

In addition, the set pressure control device 55 causes the third pilot port P3 of the LS valve 54 to be in communication with a pilot circuit 65 in the on-state. The pilot circuit 65 is connected to the hydraulic pump 22 or to another hydraulic pump which is not illustrated. When the set pressure control device 55 is in the on-state, a predetermined pilot pressure is supplied from the set pressure control device 55 to the third pilot port P3. As a result, the set pressure of the LS valve 54 is reduced from the first pressure to the second pressure.

The control of the set pressure performed by the controller 25 will be explained next. The controller 25 controls the set pressure control device 55 so as to reduce the set pressure more when a predetermined determination condition is satisfied than when the determination condition is not satisfied. The predetermined determination condition is that the work implement 4 is not being operated and the travel device 3 is in the reverse travel state.

The controller 25 determines whether or not the work implement 4 is being operated based on the operating amount of the work implement operating member 45. The controller 25 determines that the work implement 4 is not being operated when the operating amount of the work implement operating member 45 is zero. The controller 25 may determine that the work implement 4 is not being operated when the operating amount of the work implement operating member 45 is approximately zero. The controller 25 determines that the travel device 3 is in the reverse travel state when the travel operating member 46 is positioned in the reverse travel position.

In FIG. 4, "F" represents the forward travel position, "N" represents the neutral position, and "R" represents the reverse travel position "OFF" indicates that the predetermined determination condition is not satisfied, that is, that the set pressure control device 55 enters the off-state. "ON" indicates that the predetermined determination condition is satisfied, that is, that the set pressure control device 55 enters the on-state. As illustrated in FIG. 4, when the work implement 4 is being operated, the controller 25 sets the set pressure control device 55 to the off-state even if the travel operating member 46 is in any of the forward travel position, the neutral position, or the reverse travel position. Therefore, the controller 25 sets the set pressure control device 55 to the off-state and sets the set pressure to the first pressure when the work implement 4 is being operated. Consequently, the pump control device 28 controls the discharge displacement of the hydraulic pump 22 so that the differential pressure is held at the first pressure.

Moreover, even when the work implement 4 is not being operated, the controller 25 sets the set pressure control device 55 to the off-state if the travel operating member 46 is in the forward travel position or the neutral position. Therefore, the controller 25 sets the set pressure to the first pressure when the travel operating member 46 is in the forward travel position or the neutral position regardless of whether the work implement 4 is being operated or not.

When the work implement 4 is not being operated and the travel operating member 46 is in the reverse travel position, the controller 25 sets the set pressure control device 55 to the on-state and sets the set pressure to the second pressure which is less than the first pressure. Consequently, the pump control device 28 controls the discharge displacement of the hydraulic pump 22 so that the differential pressure is maintained at the second pressure.

Figure 5:
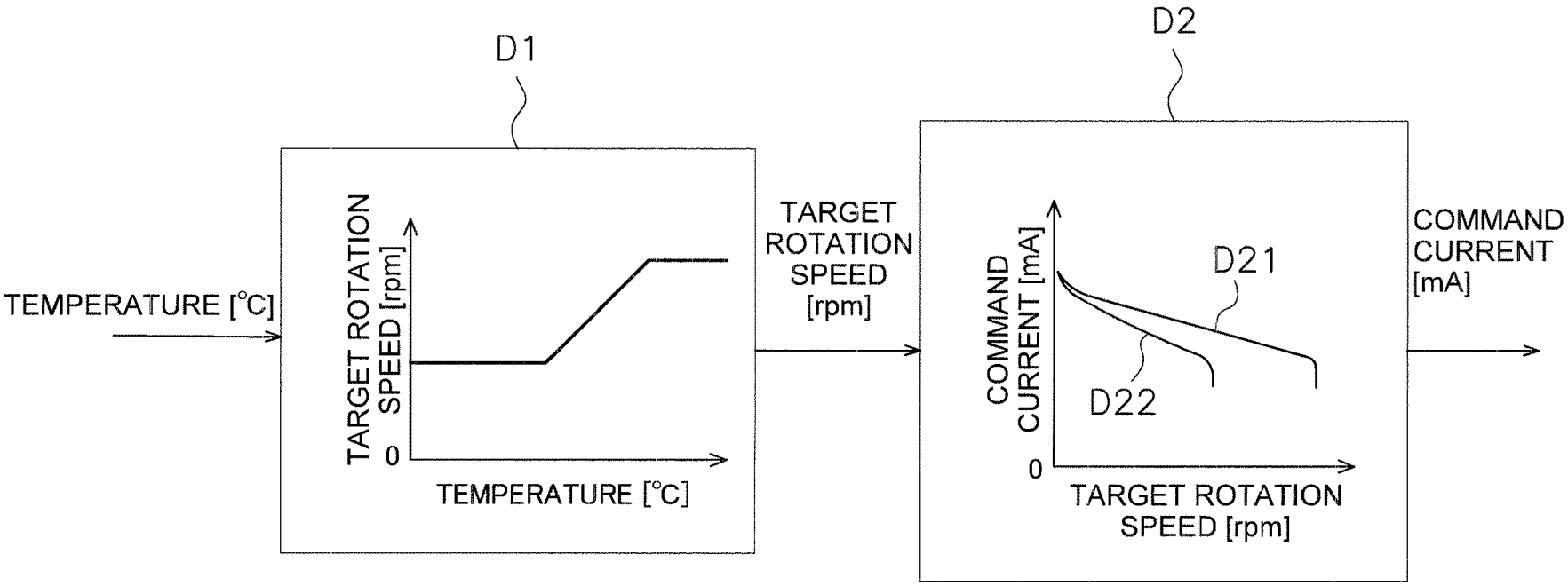
FIG. 5 illustrates a control method for a fan.

The control of the fan control valve 41 performed by the controller 25 will be explained next. The controller 25 determines a target rotation speed of the fan 33 in accordance with the temperature of the cooling water, and controls the fan control valve 41 in accordance with the target rotation speed. As illustrated in FIG. 5, the controller 25 has target rotation speed data D1 and control valve command data D2. The target rotation speed data D1 defines a relationship between the temperature of the cooling water and the target rotation speed of the fan 33. The controller 25 refers to the target rotation speed data D1 and determines the target rotation speed from the temperature of the cooling water. The target rotation speed data D1 may define a relationship between the temperature of the hydraulic fluid and/or the air intake temperature of the engine 21, and the target rotation speed of the fan 33, without being limited to the temperature of the cooling water. The controller 25 may refer to the target rotation speed data D1 and determine the target rotation speed from the temperature of the hydraulic fluid and/or the air intake temperature of the engine 21.

The control valve command data D2 defines a relationship between a command current to the fan control valve 41 and the target rotation speed of the fan 33. The command current to the fan control valve 41 represents the opening degree of the control valve 24. The smaller the command current, the greater the opening degree of the control valve 24. The control valve command data D2 includes first command value data D21 and second command value data D22. The second command value data D22 defines a command current that is smaller than the first command value data D21 with respect to the same target rotation speed. That is, the second command value data D22 defines an opening degree that is larger than that of the first command value data D21 with respect to the same target rotation speed.

The controller 25 refers to the first command value data D21 and determines the opening degree of the control valve 24 when the set pressure control device 55 is in the off-state. The controller 25 refers to the second command value data D22 and determines the opening degree of the control valve 24 when the set pressure control device 55 is in the on-state. Therefore, when the set pressure control device 55 is in the on-state, the controller 25 controls the fan control valve 41 so that the opening degree of the fan control valve 41 increases more than when the set pressure control device 55 is in the off-state.

In the work machine 1 according to the present embodiment explained above, the set pressure is reduced to the second pressure when the work implement 4 is not being operated more so than when the work implement 4 is being operated. Therefore, the discharge displacement of the hydraulic pump 22 is controlled so that the differential pressure between the discharge pressure of the hydraulic pump 22 and the load pressure of the hydraulic actuators 10 is reduced when the work implement 4 is not being operated. Accordingly, energy loss of the hydraulic pump 22 can be reduced. In addition, even when the set pressure is set to the second pressure, a differential pressure for properly actuating the hydraulic motor 32 is assured. Consequently, the cooling capacity by the fan 33 can be sufficiently assured. Furthermore, when the work implement 4 is being operated, the set pressure is not reduced to the second pressure and is maintained at the first pressure. Consequently, a reduction in the operability of the work implement 4 can be suppressed.

The set pressure is reduced when the work implement 4 is not being operated and the travel device 3 is in the reverse travel state. In the work machine 1, the work implement 4 is not operated very often when the travel device 3 is in the reverse travel state. As a result, when the travel device 3 is in the reverse travel state, the set pressure is reduced whereby a reduction in the operability of the work implement 4 can be suppressed.

When the set pressure control device 55 is in the on-state, the controller 25 causes the opening degree of the fan control valve 41 to increase more than when the set pressure control device 55 is in the off-state. Therefore, the set pressure is reduced whereby a reduction in the rotation speed of the fan 33 can be suppressed even when the differential pressure is reduced.

Although an embodiment of the present invention has been described so far, the present invention is not limited to the above embodiment and various modifications may be made within the scope of the invention. The work machine 1 is not limited to a bulldozer and may be another vehicle such as a hydraulic excavator, a wheel loader, or a motor grader or the like. The travel device 3 is not limited to crawler belts and may include other members such as tires. The work implement 4 is not limited to a blade and may include another member such as a bucket.

The hydraulic actuators are not limited to the above-mentioned lift cylinder, tilt cylinder, and angle cylinder, and may include other actuators. The configuration of the pump control device is not limited to that of the above-mentioned embodiment and may be modified. For example, the configuration of the hydraulic circuit of the pump control device may be modified. The set pressure control device may be capable of continually changing the set pressure.

The determination conditions are not limited to the above embodiment and may be modified. For example, the condition pertaining to the travel operating member may be modified or omitted. Alternatively, another condition may be added to the determination conditions.

According to the present invention, energy loss of the hydraulic pump in the work machine can be reduced.

The invention claimed is:

1. A work machine comprising:

a variable displacement hydraulic pump;

a plurality of hydraulic actuators including a work implement actuator and a hydraulic motor, the plurality of hydraulic actuators being driven by hydraulic fluid discharged from the hydraulic pump;

a work implement connected to the work implement actuator;

a fan connected to the hydraulic motor;

a control valve configured to control a flow rate of the hydraulic fluid supplied from the hydraulic pump to the plurality of hydraulic actuators;

a regulator configured to control a discharge displacement of the hydraulic pump;

a load sensing valve configured to control the regulator in accordance with a differential pressure between a discharge pressure of the hydraulic pump and a load pressure of the plurality of hydraulic actuators to maintain the differential pressure at a set pressure;

a set pressure control device configured to control the set pressure;

a controller configured to control the set pressure control device so that the set pressure is reduced more when a determination condition including the work implement not being operated is satisfied than when the work implement is being operated; and a travel device that causes the work machine to travel, the predetermined determination condition further including the travel device being in a reverse travel state.

2. The work machine according to claim 1, wherein the controller is further configured to control the set pressure control device so that the set pressure is set to a first pressure when the work implement is being operated, and control the set pressure control device so that the set pressure is set to a second pressure when the predetermined determination condition is satisfied, the second pressure being smaller than the first pressure.

3. The work machine according to claim 1, further comprising a travel operating member for operating the travel device, the travel operating member being manually operable in a forward travel position, a reverse travel position, and a neutral position, the controller being configured to determine that the travel device is in the reverse travel state when the travel operating member is positioned in the reverse travel position.

4. The work machine according to claim 1, further comprising a work implement operating member for operating the work implement, the controller being configured to determine whether the work implement is being operated based on an operating amount of the work implement operating member.

5. A work machine comprising:

a variable displacement hydraulic pump;

a plurality of hydraulic actuators including a work implement actuator and a hydraulic motor, the plurality of hydraulic actuators being driven by hydraulic fluid discharged from the hydraulic pump;

a work implement connected to the work implement actuator;

a fan connected to the hydraulic motor;

a control valve configured to control a flow rate of the hydraulic fluid supplied from the hydraulic pump to the plurality of hydraulic actuators;

a regulator configured to control a discharge displacement of the hydraulic pump;

a load sensing valve configured to control the regulator in accordance with a differential pressure between a discharge pressure of the hydraulic pump and a load pressure of the plurality of hydraulic actuators to maintain the differential pressure at a set pressure;

a set pressure control device configured to control the set pressure; and a controller configured to control the set pressure control device so that the set pressure is reduced more when a determination condition including the work implement not being operated is satisfied than when the work implement is being operated, the control valve including a fan control valve that controls a flow rate of the hydraulic fluid supplied to the hydraulic motor from the hydraulic pump, and the controller being further configured to control the fan control valve so that an opening degree of the fan control valve increases more when the predetermined determination condition is satisfied than when the work implement is being operated.

6. The work machine according to claim 5, wherein the controller has first command value data that defines a relationship between a command value indicative of the opening degree of the fan control valve and a target rotation speed of the fan, and second command value data that defines a relationship with a command value indicative of the opening degree that is larger than that of the first command value data with respect to a same target rotation speed, and the controller is further configured to refer to the first command value data to determine the opening degree of the fan control valve when the work implement is being operated; and refer to the second command value data to determine the opening degree of the fan control valve when the predetermined determination condition is satisfied.

* * * * *